US005313702A

United States Patent [19]

Fischer, Jr. et al.

[11] Patent Number: 5,313,702

[45] Date of Patent: May 24, 1994

[54] ELECTRICAL TERMINATION AND METHOD FOR MAKING SAME

[75] Inventors: Adam Fischer, Jr., Memphis, Tenn.; Richard F. Strauss, Morrisville, Pa.; Kwang-Ho Chu, Austin, Tex.; Sidney Levy, Belle Mead, N.J.; Mark Hurt, Telford, Pa.

[73] Assignee: Thomas & Betts Corporation, Bridgewater, N.J.

[21] Appl. No.: 998,822

[22] Filed: Dec. 30, 1992

[51] Int. Cl.[5] ..... H01R 13/00

[52] U.S. Cl. ..... 29/883; 439/413

[58] Field of Search ..... 29/747, 883, 885

[56] References Cited

U.S. PATENT DOCUMENTS

| | | | |
|---|---|---|---|
| 2,881,479 | 4/1959 | Quackenbush | 29/883 |
| 3,656,233 | 4/1972 | Overholser | 29/883 |
| 4,301,325 | 11/1981 | Hutchison | 29/883 |

*Primary Examiner*—Joseph H. McGlynn
*Attorney, Agent, or Firm*—Robin, Blecker, Daley & Driscoll

[57] ABSTRACT

A method for terminating an electrical conductor, comprises an outset step of defining a housing having an open end and a closed end and at least one passage therethrough for entry of the conductor into the housing to permit a termination end of the conductor to be resident interiorly in the housing. Next, the housing passage is closed and the housing is disposed with the housing open end vertically above the housing closed end. With the housing so disposed, sealant gel is introduced in liquid state interiorly of the housing. While the sealant gel is in the liquid state, there is secured with the housing, through the housing open end, apparatus for subsequent use in terminating the conductor, Upon transition of the sealant gel to a cured state, the housing passage is opened. To complete the conductor terminating method, at the installation site, the conductor is inserted into the housing passage and into registry with the terminating apparatus. One now operates the terminating apparatus to terminate the conductor. An insulation-displacement contact defines first and second beams bounding a conductor-receiving slot, the beams defining respective first and second notched insulation-displacement segments at respective leading and trailing parts thereof which are of triangular configuration having triangle bases aligned with the conductor entry passage.

14 Claims, 4 Drawing Sheets

ELECTRICAL TERMINATION AND METHOD FOR MAKING SAME

FIELD OF THE INVENTION

This invention relates generally to termination of electrical conductors and pertains more particularly to improvements in the termination of multiconductor telecommunication cables to drop wires feeding local telephone distribution.

BACKGROUND OF THE INVENTION

A current practice providing connectors for the termination of multiconductor telecommunication cables to drop wires feeding local telephone distribution is seen in commonly-assigned U.S. Pat. No. 4,993,966, to which incorporating reference is made for all purposes.

In the '966 arrangement, a connector block having a stub cable assembled therewith is adapted for the receipt of terminal modules, which are fabricated separately from the assembly of connector block and stub cable. The terminal module comprises a base securable with the connector block and adapted to support insulation-displacement contacts (IDCs), a drop wire support member having conductor seats, through which the contacts extend, a cap or housing element, and a bolt extending through the cap and threadably engageable with the base. The cap defines passages therethrough in registry with the conductor seats of the support member to permit entry of the conductors to be terminated into the module.

To protect the conductor terminations from ambient environment, particularly moisture ingress, a sealant gel is disposed in the module around the IDCs. To complete termination, the conductors are inserted into the module through the sealant gel and the bolt is threaded into the base, advancing the IDCs into terminating engagement with the conductors within the sealant gel, thereby sealing the conductor and IDCs and the termination. As is discussed also in the '966 patent, the contacts extend outwardly of the base and are connected to conductors of the stub cable.

One aspect of the terminal modules and electrical connector terminations under consideration is expeditious manufacturability thereof. In particular, the preferred gel is a compound that is in a liquid state and cures with time and temperature to a suitable consistency. It is desirable to manufacture the terminal modules using such a gel in a manner that is most cost-effective and easiest to handle during fabrication processing.

SUMMARY OF THE INVENTION

The present invention has as its primary object the provision of terminal modules exhibiting improved characteristics in respect of sealant gel usage and enhanced termination of diversely-sized conductors.

In attaining the above-noted objective, the invention provides, in one aspect thereof, a method for terminating an electrical conductor, comprising an outset step of defining a housing having an open end and a closed end and at least one passage therethrough for entry of the conductor into the housing to permit a termination end of the conductor to be resident interiorly of the housing. Next, the housing passage is closed and the housing is disposed with the housing open end vertically above the housing closed end. With the housing so disposed, sealant gel is introduced in flowable, state interiorly of the housing. While the sealant gel is in the liquid state, there is secured with the housing, through the housing open end, apparatus for subsequent use in terminating the conductor, Upon transition of the sealant gel to a cured state, the housing passage is opened.

To complete the conductor terminating method, at the installation site, the conductor is inserted into the housing passage and into registry with the terminating apparatus. One now operates the terminating apparatus to terminate the conductor.

In preferred practice, the conductor comprises a conductive member within an electrically-insulative sleeve and the terminating apparatus is selected to be of insulation-displacement character. Further, the housing closed end is desirably rendered closed by residence of a component of the terminating means in the housing closed end.

The step of closing the housing passage is practiced by securing a closure member to the housing in registry with exterior housing surface bounding the passage, the closure member being selected to have extent confronting the passage and closing the same. Preferably, the closure member is selected to be of heat-shrinkable material and is secured to the housing in circumscribing relation thereto and encompassing exterior housing surface bounding the passage.

The invention also will be seen as providing improved methods for making terminal modules.

A further aspect of the invention is to provide improved IDCs adapted for enhanced re-use in terminating a smaller diameter conductor following prior us thereof in terminating a larger diameter conductor.

In such IDC/terminal module improvement aspect, the invention provides, in a terminal module for terminating an electrical conductor, comprising a base, an insulation-displacement contact supported by the base, a housing securable to the base and defining conductor entry passage in registry with the insulation-displacement contact; and operatable means cooperative with said insulation-displacement contact for terminating said conductor, the operatable means operating to advance the base and the housing into securement, whereby the insulation-displacement contact electrically engages the conductor, the improvement wherein the insulation-displacement contact defines first and second beams bounding a conductor-receiving slot, the beams defining respective first and second notched insulation-displacement segments at respective leading and trailing parts thereof which are of triangular configuration having triangle bases aligned with the conductor entry passage.

The foregoing and other objects and features of the invention will be further understood from the following detailed description of a preferred embodiment thereof and from the drawings, wherein like reference numerals identify like components throughout.

DESCRIPTION OF THE DRAWINGS

FIG. 5(*a*) shows the FIG. 5 subassembly inverted and with film 106 stripped therefrom and conductors C1 and C2 inserted through passages 76.

DETAILED DESCRIPTION OF PREFERRED EMBODIMENTS AND PRACTICES

Figure 1:
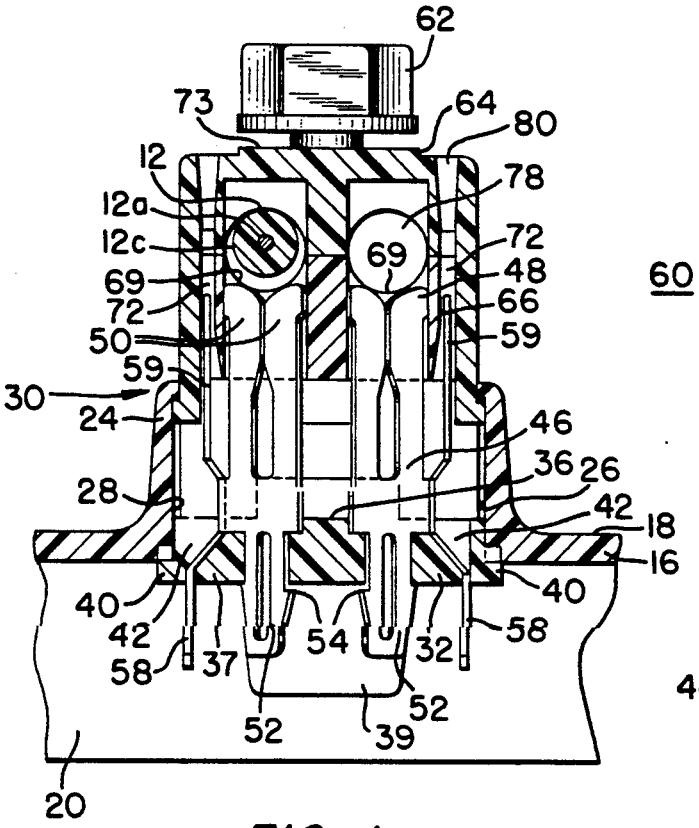
FIG. 1 (PRIOR ART)
FIG. 1 is a replication of FIG. 3 of the commonly-assigned '966 patent.
Figure 2:
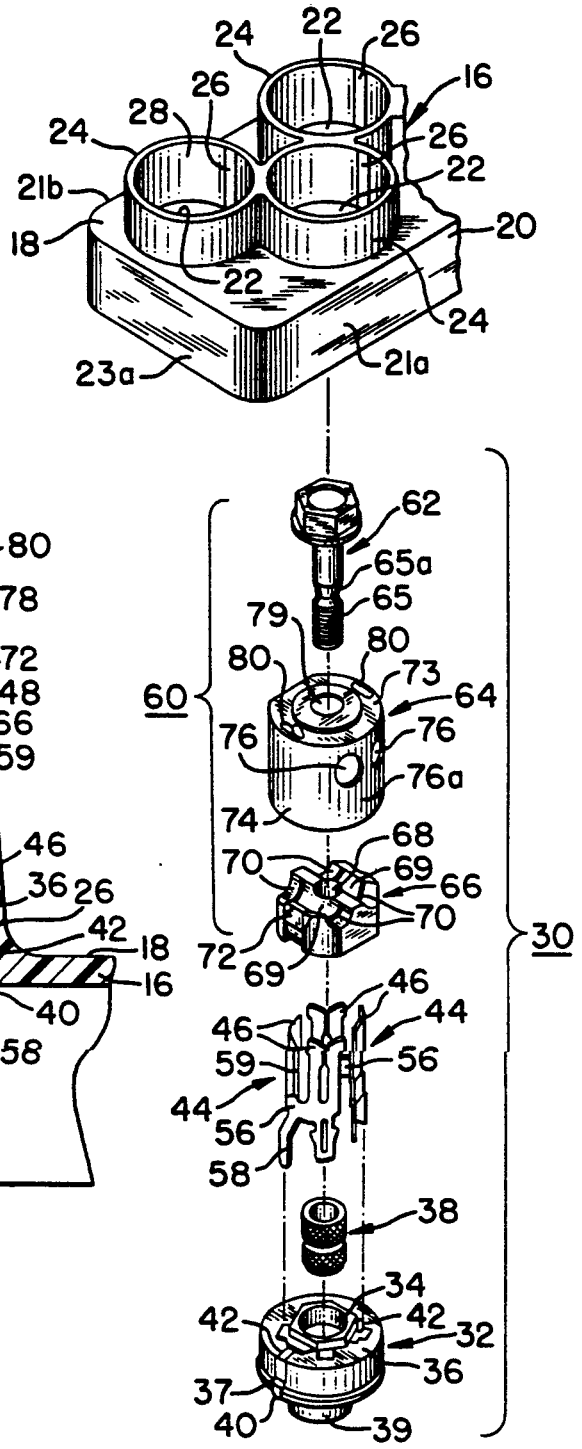
FIG. 2 (PRIOR ART)
FIG. 2 is a replication of FIG. 4 of the commonly-assigned '966 patent.
Figure 3:
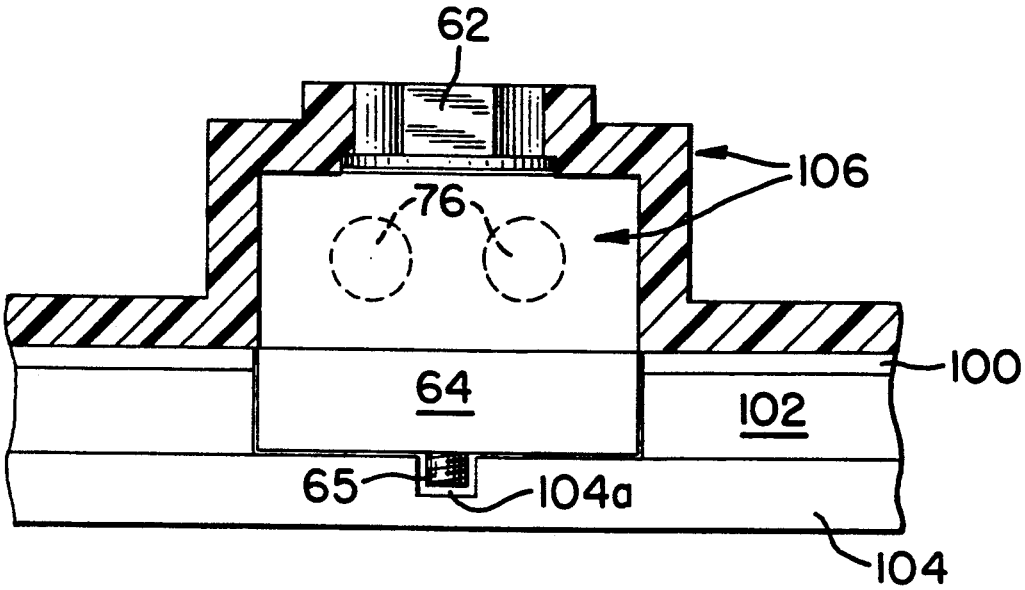
FIG. 3 is a schematic illustration depicting a first subassembly reached by practice of several steps of the method of the present invention.
Figure 4:
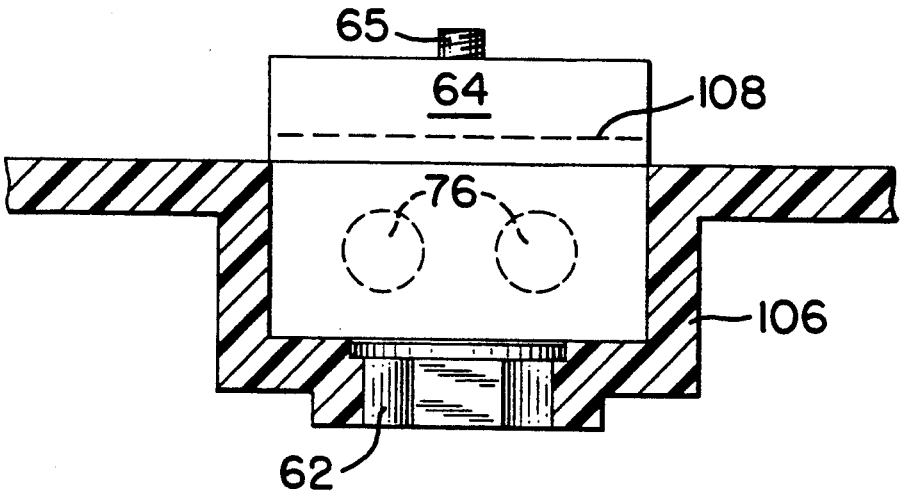
FIG. 4 is a schematic illustration of a further subassembly depicting the result of the sealant gel introduction step of the method of the invention.

By way of introduction to the ensuing discussion of the invention, applicants include FIGS. 3 and 4 of the '966 patent as FIGS. 1 and 2 hereof and note the following components thereof, an understanding of those components not now discussed, but indicated in the incorporated drawings, being available in the '966 patent.

Terminal module 30 comprises a base 32 supporting insulation-displacement contacts (IDCs) 44, a drop wire support member 66 having slotted conductor seats 70, through which the contacts extend, a cap or housing element 64, and a bolt 62, extending through the cap and threadably engageable with the base through internally-threaded bolt-receiving member 38. The cap defines passages 76 therethrough in registry with the conductor seats of support member 66 to permit entry of the conductors to be terminated into the module and also defines passages 80 which permit entry of a test probe.

As above discussed, to protect the conductor terminations from ambient environment, particular moisture ingress, sealant gel is introduced into the module prior to insertion of the conductors. The conductors are inserted into the module and bolt 62 is threaded into member 38, advancing the IDCs into terminating engagement with the conductors.

Turning now to FIG. 3, the method of the subject invention involves the use of a support member 100, such as cardboard or like relatively stiff sheet material, provided with a cutout for inserting cap 64 therethrough, a porous member 102, through which vacuum pressure may be applied to support member 100, and backing member 104. Backing member 104 is air-impervious, thus sustaining the vacuum pressure in porous member 102, and may be comprised of any material suited for such purpose, such as rubber. Backing member 104 defines a notched portion 104*a*, suited to receive threaded portion 65 of bolt 62, which is exterior of cap 64.

Heat-shrinkable film 106 is applied to support member 100 and in circumscribing relation to cap 64, the film being selected to have extent confronting passages 76 and sealingly closing the same upon heat application thereto.

Vacuum pressure conditions are now established within porous member 102, thus drawing film 106 tightly upon structure thereunder, and heat is applied to the film.

The subassembly of FIG. 4 emerges from the above practice upon removal of members 100, 102 and 104 from the composite of bolt 62, cap 64 and film 106, or vice versa, and the subassembly is inverted from its FIG. 3 disposition. In this connection, the inversion places the open end of cap 64, through which bolt 62 extends, vertically above the end thereof closed by bolt 62.

Also indicated in FIG. 4 is the result of the further step of the subject method, wherein sealant gel 108 is introduced in flowable state into the interior of cap 64 to a desired sealant gel level.

Figure 5A:
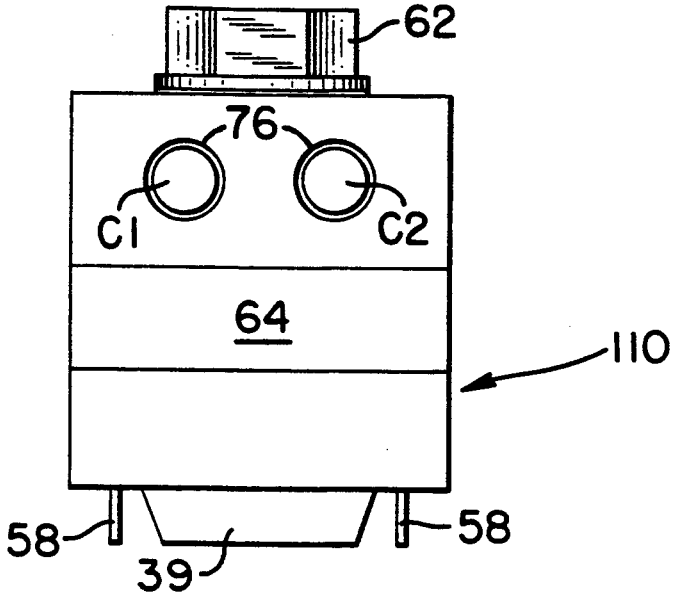
FIG. 5 is a schematic illustration of a still further subassembly reached in practicing the method of the invention.
Figure 5:
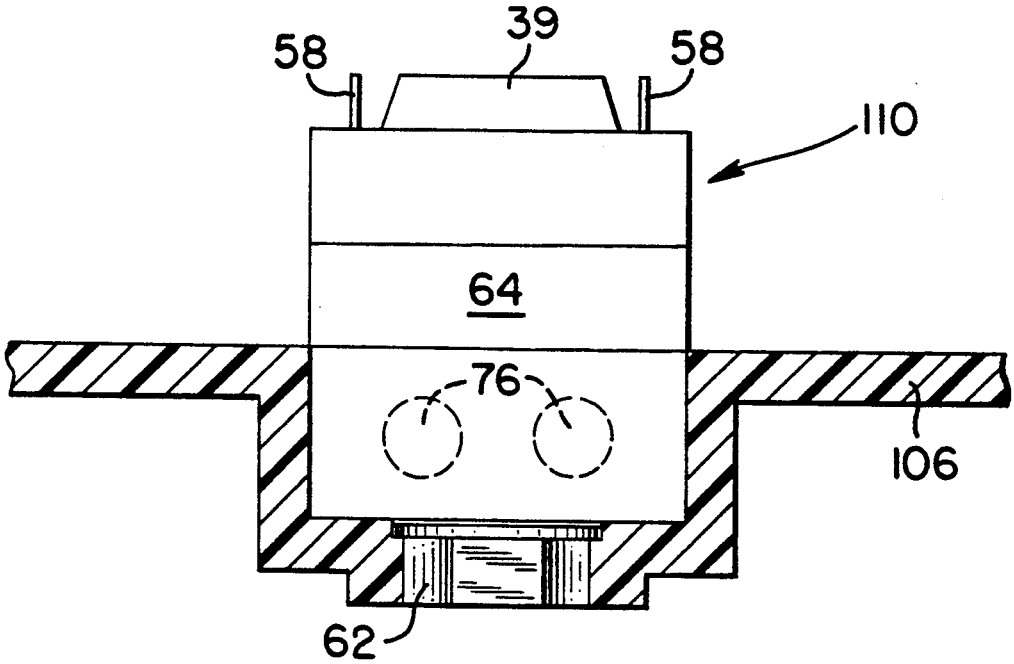

While the introduced sealant gel is in flowable state, i.e., prior to a time at which the same attains a cured state, the remnant components of the terminal module, indicated as 110 in FIG. 5, are assembled with the FIG. 4 subassembly, thus reaching the further subassembly of FIG. 5. Lower terminals 58 and base extension portion 39 extend upwardly and exteriorly of the FIG. 5 subassembly. While the gel is in its flowable state, preferably immediately after its introduction, bolt 62 is threaded into engagement with internally-threaded bolt-receiving member 38 (FIG. 2). By this step, the positional relationship between the components of the subassembly of FIG. 5 is established and remains so as against displacement pressures which can occur during curing and expansion of the sealant gel.

Upon the introduced sealant gel attaining its cured state, film 106 is removed from the FIG. 5 subassembly, providing a completed terminal module.

The conductor terminating method of the invention involves the evident further steps of inserting the fabricated terminal module into support structure shown in FIGS. 1 and 2 of the '966 patent, connecting the outboard ends of the IDCs to the stub cable, inserting conductors to be terminated into now-open passages 76 of cap 64 into registry with conductor seats 70, and operating the conductor terminating apparatus, i.e., threading bolt 62 portion 65 further into internally-threaded bolt-receiving member 38.

Figure 7:
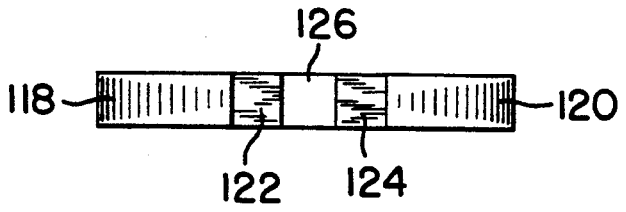
FIG. 7 is a top plan view of the FIG. 6 IDC embodiment.
Figure 6:
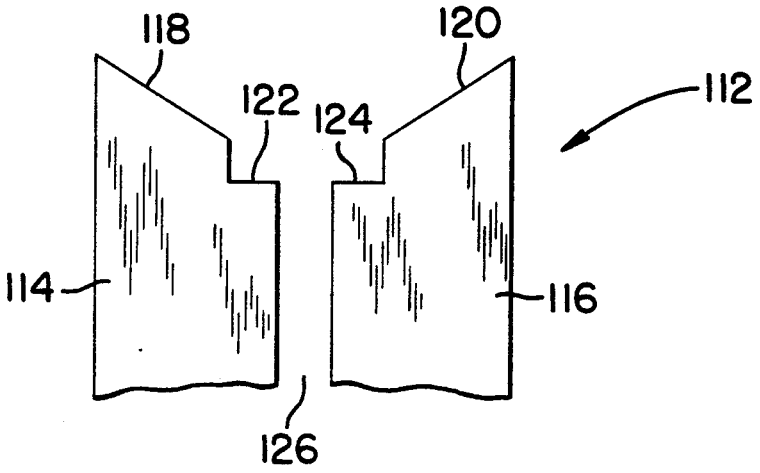
FIG. 6 is a front elevation of an IDC embodiment in accordance with the invention.
Figure 8:
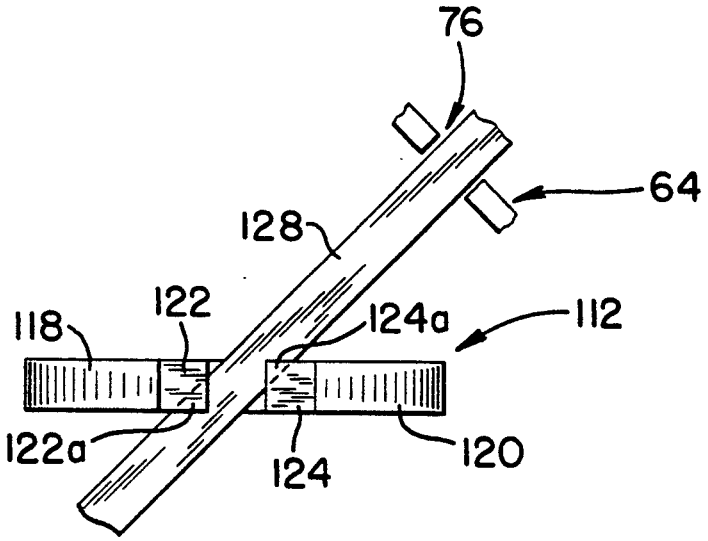
FIG. 8 is a repeat view of FIG. 7 with the IDC in engagement with a conductor extending through the housing passage into the interior thereof.

Turning now to FIGS. 6–8, applicants provide IDC 112, intended for use in substitution for IDCs 44 of the '996 patent. IDC 112 includes beams 114 and 116, the conductor-confronting ends of which define inclined piercing surfaces 118 and 120 and notched horizontal piercing surfaces 122 and 124, in respective downwardly-stepped contiguity with inclined piercing surfaces 118 and 120, surfaces 122 and 124 having interior ends at slot 126.

In the course of terminating a smaller diameter conductor, such as is indicated at 128, IDC 112 presents notched triangular segments thereof, indicated at 122*a* and 124*a* to the conductor, such segments being respective leading and trailing parts of horizontal piercing surfaces 122 and 124 with respect to passage 76 of cap 64.

In summary of such IDC/terminal module improvement aspect, the invention provides, in a terminal module for terminating an electrical conductor 128, comprising a base, an insulation-displacement contact 112 supported by the base, a housing 64 securable to the base and defining a conductor entry passage 76 in registry with insulation-displacement contact 112 and operatable means cooperative with the insulation-displacement contact for terminating the conductor, the operatable means operating to advance the base and the housing into securement, whereby the insulation-displacement contact electrically engages the conductor, the improvement wherein the insulation-displacement contact defines first and second beams 114 and 116 bounding conductor-receiving slot 126, the beams defining respective first and second notched segments at respective leading and trailing parts thereof which are of triangular configuration having triangle bases aligned with the conductor entry passage.

The insulation-displacement contact beams further define respective third and fourth segments 118 and 120 extending exteriorly of the first and second segments with respect to said conductor-receiving slot. The third and fourth segments are disposed in acute angular relation to the first and second segments.

Various changes in structure to the described terminal module and practices for terminating conductors may evidently be introduced without departing from the invention. In one such modification, the invention looks to incorporation in its terminal modules of structure such as is shown in commonly-assigned U.S. Pat. No. 5,090,917, which is incorporated herein for all purposes. In the '917 patent, resilient plunger means is effectively used in the terminal module to store and later replenish sealant gel disposed originally in the terminal module on re-use thereof. In another modification in practice, the invention contemplates lessening of the amount of heat-shrinkable film necessary to close passages in the cap 64. Thus, while the foregoing practice is to fully circumscribe the cap, including its surface adjacent bolt 62 for closing probe passages 80, passages 80 may be closed during cap molding by so-called "flash-over" and the film accordingly need not extend over passages 80. In such modified practice, passages 80 are rendered open in the finalized module by the entry of a probe therein. Accordingly, it is to be understood that the particularly disclosed and depicted embodiments and practices are intended in an illustrative and not in a limiting sense. The true spirit and scope of the invention are set forth in the following claims.

What is claimed is:

1. A method for terminating an electrical conductor, comprising the steps of:

(a) defining a housing having an open end and a closed end and at least one passage therethrough for entry of said conductor into said housing to permit a termination end of said conductor to be resident interiorly in said housing;

(b) closing said housing passage;

(c) disposing said housing with said housing open end vertically above said housing closed end and introducing sealant gel in flowable state interiorly of said housing;

(d) while said sealant gel is in said flowable state, securing with said housing, through said housing open end, means for terminating said electrical conductor;

(e) upon transition of said sealant gel to a cured state, opening said housing passage;

(f) inserting said conductor into said housing passage and into registry with said terminating means; and (g) operating said terminating means to terminate said conductor.

2. The method claimed in claim 1 wherein said conductor comprises a conductive member within an electrically-insulative sleeve and wherein said terminating means is selected to be of insulation-displacement character.

3. The method claimed in claim 1 wherein said housing closed end is rendered closed by residence of a component of said terminating means in said housing closed end.

4. The method claimed in claim 1 wherein said step of closing said housing passage is practiced by securing a closure member to said housing in registry with exterior housing surface bounding said passage, said closure member being selected to have extent confronting said passage and closing the same.

5. The method claimed in claim 4 wherein said closure member is selected to be of heat-shrinkable material.

6. The method claimed in claim 1 wherein said step of closing said housing passage is practiced by securing a closure member to said housing in circumscribing relation thereto and encompassing exterior housing surface bounding said passage.

7. The method claimed in claim 6 wherein said closure member is selected to be of heat-shrinkable material.

8. A method for providing a terminal module for terminating an electrical conductor, comprising the steps of:

(a) defining a housing having an open end and a closed end and at least one passage therethrough for entry of said conductor into said housing to permit a termination end of said conductor to be resident interiorly in said housing;

(b) closing said housing passage;

(c) disposing said housing with said housing open end vertically above said housing closed end and introducing sealant gel in flowable state interiorly of said housing;

(d) while said sealant gel is in said flowable state, securing with said housing, through said housing open end, means for terminating said electrical conductor; and (e) upon transition of said sealant gel to a cured state, opening said housing passage.

9. The method claimed in claim 8 wherein said conductor comprises a conductive member within an electrically-insulative sleeve and wherein said terminating means is selected to be of insulation-displacement character.

10. The method claimed in claim 8 wherein said housing closed end is rendered closed by residence of a component of said terminating means in said housing closed end.

11. The method claimed in claim 8 wherein said step of closing said housing passage is practiced by securing a closure member to said housing in registry with exterior housing surface bounding said passage, said closure member being selected to have extent confronting said passage and closing the same.

12. The method claimed in claim 11 wherein said closure member is selected to be of heat-shrinkable material.

13. The method claimed in claim 8 wherein said step of closing said housing passage is practiced by securing a closure member to said housing in circumscribing relation thereto and encompassing exterior housing surface bounding said passage.

14. The method claimed in claim 13 wherein said closure member is selected to be of heat-shrinkable material.

* * * * *